US010211569B2

(12) United States Patent
Aoki et al.

(10) Patent No.: US 10,211,569 B2
(45) Date of Patent: Feb. 19, 2019

(54) CONNECTOR DEVICE

(71) Applicant: Yazaki Corporation, Tokyo (JP)

(72) Inventors: Eiji Aoki, Shizuoka (JP); Kazuhiro Maruno, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/970,616

(22) Filed: May 3, 2018

(65) Prior Publication Data

US 2018/0337492 A1 Nov. 22, 2018

(30) Foreign Application Priority Data

May 19, 2017 (JP) ..... 2017-099854

(51) Int. Cl.

| | |
|---|---|
| ***H01R 13/629*** | (2006.01) |
| ***H01R 13/703*** | (2006.01) |
| ***H01H 9/08*** | (2006.01) |
| ***H01R 13/707*** | (2006.01) |
| ***H01R 9/16*** | (2006.01) |
| *H01R 13/641* | (2006.01) |

(52) U.S. Cl.

CPC ..... *H01R 13/62933* (2013.01); *H01H 9/085* (2013.01); *H01R 9/16* (2013.01); *H01R 13/703* (2013.01); *H01R 13/707* (2013.01); *H01R 13/641* (2013.01)

(58) Field of Classification Search

CPC ..... H01R 13/62933; H01R 13/703; H01R 13/641; H01R 9/16

USPC ..... 439/271

See application file for complete search history.

(56) References Cited

U.S. PATENT DOCUMENTS

| | | | | |
|---|---|---|---|---|
| 6,200,152 | B1 * | 3/2001 | Hopper | E21B 33/03 439/310 |
| 7,172,447 | B2 * | 2/2007 | Allensworth | F16L 1/10 439/271 |
| 8,915,749 | B2 * | 12/2014 | Ikeda | H01R 13/62938 439/157 |
| 2013/0126205 | A1 * | 5/2013 | Henmi | H01H 35/003 174/53 |
| 2013/0224974 | A1 * | 8/2013 | Furuya | H01R 13/62938 439/153 |
| 2013/0228429 | A1 * | 9/2013 | Henmi | H01R 13/62933 200/335 |

(Continued)

FOREIGN PATENT DOCUMENTS

JP 2014-146451 A 8/2014

*Primary Examiner* — Alexander Gilman
(74) *Attorney, Agent, or Firm* — Kenealy Vaidya LLP

(57) ABSTRACT

A first connector including a pair of male terminals of which axial directions of rod-like bodies having a circumferential surface are aligned in the same direction and which is arranged at an interval, a conductive coupling member which couples one ends of the respective male terminals in the axial direction to each other, and a first housing which includes a male terminal housing chamber for each male terminal and a holding mechanism which holds the coupling member the male terminal includes a rod-like body having a male terminal fitting portion to be inserted and fitted into the female terminal on the other end and a spherical turning fulcrum body which is provided at the one end and enables the turn with respect to the coupling member in the male terminal housing chamber about the one end as a fulcrum.

16 Claims, 13 Drawing Sheets

(56) References Cited

U.S. PATENT DOCUMENTS

2014/0213087 A1* 7/2014 Furuya ..... H01R 9/16
439/271

* cited by examiner

CONNECTOR DEVICE

CROSS-REFERENCE TO RELATED APPLICATION(S)

The present application claims priority to and incorporates by reference the entire contents of Japanese Patent Application No. 2017-099854 filed in Japan on May 19, 2017.

BACKGROUND OF THE INVENTION

1. Field of the Invention

The present invention relates to a connector device.

2. Description of the Related Art

Conventionally, a connector device including a first connector and a second connector which can be fitted to and separated from each other has been known. In the connector device, by fitting the first connector and the second connector to each other, an energizing circuit which operates according to the electrical connection between the first connector and the second connector can be formed. On the other hand, in this connector device, by separating the first connector from the second connector, the first connector and the second connector having been fitted to each other, the electrical connection between the first connector and the second connector is released, and the energizing circuit can be disconnected. This type of connector device is disclosed, for example, in Japanese Patent Application Laid-open No. 2014-146451. The connector device disclosed in Japanese Patent Application Laid-open No. 2014-146451 includes a first connector and a second connector. In the first connector, a pair of bar-shaped and cylindrical male terminals is coupled and fixed to each other with a plate-like conductor, and in the second connector, cylindrical female terminals to which the respective male terminals are inserted and fitted along the axial direction are provided.

Meanwhile, in the connector device, in consideration of fitting workability between the first connector and the second connector, a play (backlash) is provided between fitting portions of housings. Furthermore, in the first connector, two male terminals and a plate-like conductor are fixed via a screw member. Due to tolerance variations and assembly variations of each component, axial directions of both male terminals do not necessarily coincide each other. Therefore, in the traditional connector device, there is a possibility that the male terminal and the female terminal do not coaxially exist, for example, by intersecting the axes with each other. An unnecessary load may be applied between the male terminal and the female terminal. Therefore, regarding the traditional connector device, it is necessary to improve the workability when the first connector and the second connector are fitted to or separated from each other.

SUMMARY OF THE INVENTION

A purpose of the invention is to provide a connector device capable of improving workability of connecting and disconnecting of a connector.

In order to achieve the above mentioned object, a connector device according to one aspect of the present invention includes a first connector that includes a pair of male terminals of which axial directions of rod-like bodies having a circumferential surface are arranged in the same direction and which is aligned at an interval, a conductive coupling member which couples one ends of the respective male terminals in the axial direction to each other, and a first housing which includes a male terminal housing chamber housing each the male terminal and a holding mechanism which holds the coupling member; and a second connector that includes a cylindrical female terminal, into which each the male terminal is inserted and fitted from the other end in the axial direction along the axial direction, for each male terminal and a second housing which includes a columnar female terminal housing chamber which coaxially houses and holds the female terminal for each female terminal. The male terminal includes the rod-like body having a male terminal fitting portion which is inserted into and fitted with the female terminal on a side of the other end, and a spherical turning fulcrum body which is provided at the one end and enables the male terminal to turn relative to the coupling member in the male terminal housing chamber about the one end as a fulcrum, and in an assembly of the pair of male terminals and the coupling member, the coupling member is interposed between the rod-like body and the turning fulcrum body.

According to another aspect of the present invention, in the connector device, the male terminal housing chamber may include a turning support portion which enables a turning movement of the turning fulcrum body along a spherical surface and supports the turning fulcrum body.

According to still another aspect of the present invention, in the connector device, the male terminal may include a male terminal fitting as the rod-like body and a turning fulcrum member as the turning fulcrum body to be fixed to the male terminal fitting.

According to another aspect of the present invention, in the connector device, the assembly may include a washer which is interposed between the male terminal fitting and the coupling member.

According to another aspect of the present invention, in the connector device, the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
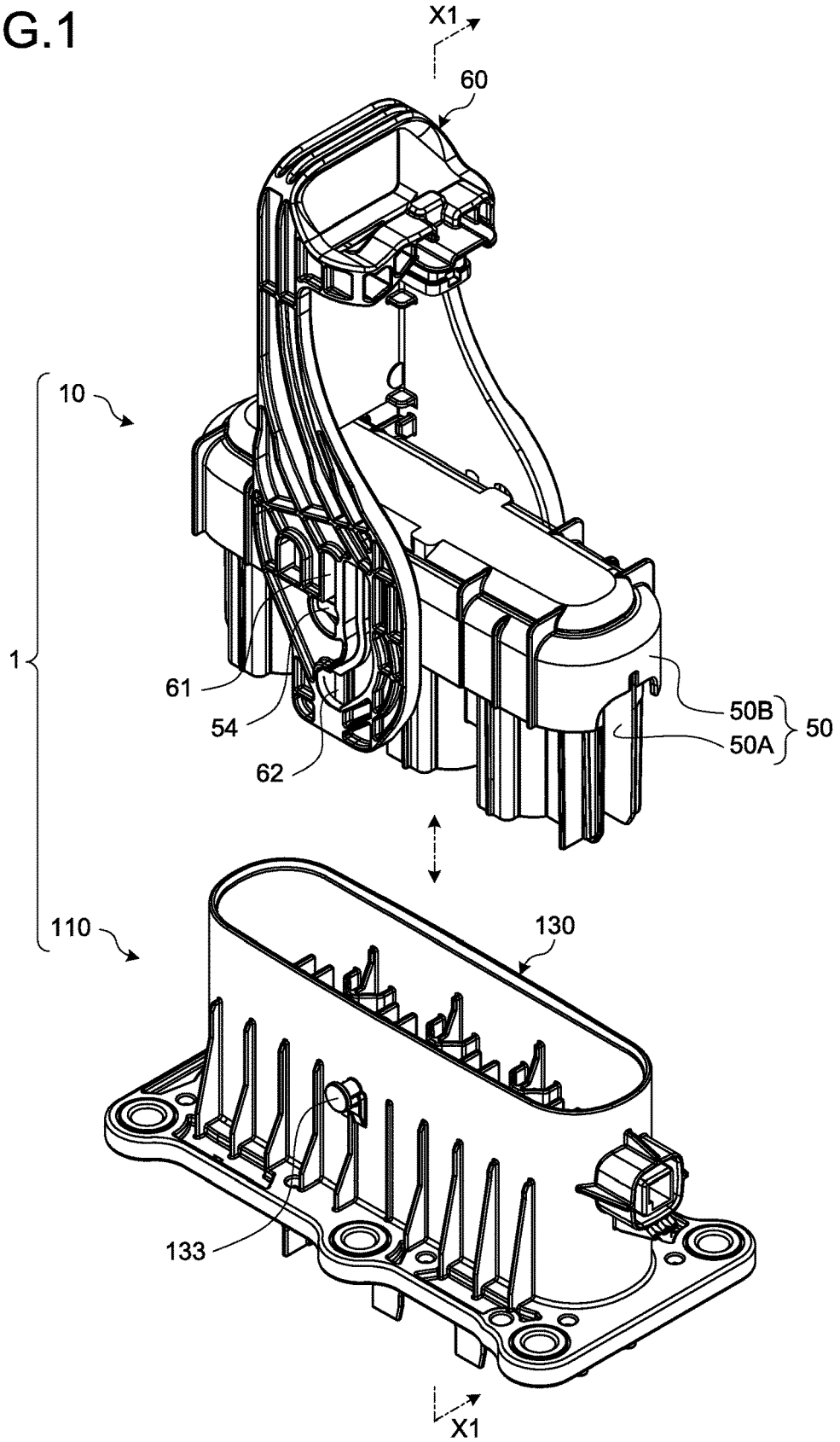
FIG. 1 is an exploded perspective view of a connector device according to an embodiment.
Figure 2:
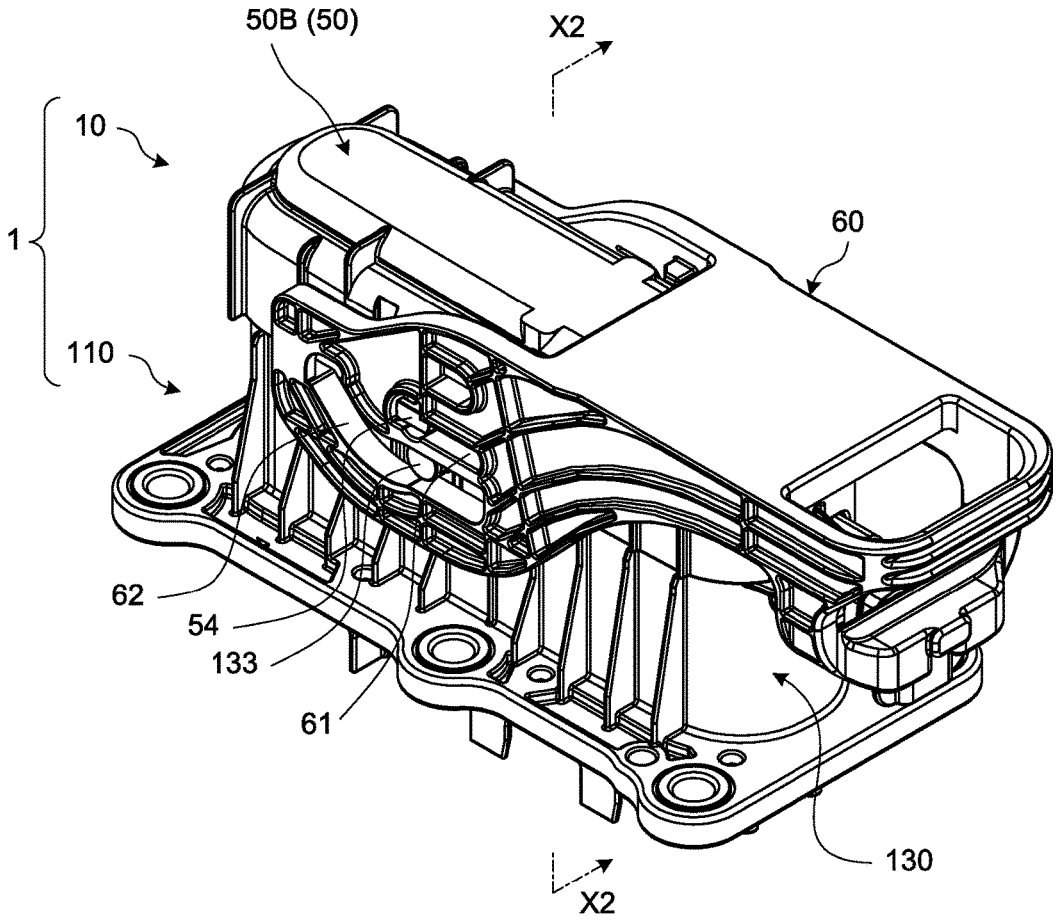
FIG. 2 is a perspective view of the connector device according to the embodiment.

An embodiment of a connector device according to the present invention will be described in detail below with reference to the drawings. The present invention is not limited to the following embodiment.

Embodiment

One embodiment of a connector device according to the present invention will be described with reference to FIGS. 1 to 13.

A reference numeral 1 in FIGS. 1 to 4 indicates the connector device according to the present embodiment. The connector device 1 includes a first connector 10 and a second connector 110. The first connector 10 and the second connector 110 are inserted and connected to each other to form an energizing circuit, and the energizing circuit is disconnected by extracting and separating the first and second connectors from each other. In the following description, an inserting direction of the second connector 110 into the first connector 10 is referred to as a "connector insertion direction", and an extracting direction of the second connector 110 from the first connector 10 is referred to as a "connector extraction direction". In the following description, a direction along which the first connector 10 and the second connector 110 are inserted into and extracted from each other is referred to as a "connector insertion/extraction direction". However, at the time when these directions are compared with an inclination to be described later, it is assumed that these directions indicate design values that do not include design tolerances and assembly variations of components.

The first connector 10 includes a pair of male terminals 20, a conductive coupling member 30 which couples the pair of male terminals 20, and a first housing 50 which houses an assembly 40 of the pair of male terminals 20 and the coupling member 30 (referred to as "male terminal assembly") (FIGS. 3 to 6). In the first connector 10, at least one male terminal assembly 40 is housed in the first housing 50. Here, two male terminal assemblies 40 are housed in the first housing 50.

The male terminal 20 is physically and electrically connected to a counterpart conductive member (cylindrical female terminal 120 to be described later). The male terminal 20 is formed of a conductive material such as metal and formed in a rod-like shape having a circumferential surface.

Specifically, the male terminal 20 has a rod-like body 21 having a circumferential surface (FIGS. 3 and 5 to 9). The rod-like body 21 is formed into, for example, a cylindrical shape or a columnar shape. In the first connector 10, all the male terminals 20 are aligned at intervals in a state where axial directions of the rod-like bodies 21 are the same. Furthermore, in the male terminal assembly 40, one ends of the two male terminals 20 in the axial direction are coupled to each other with the coupling member 30. The male terminal 20 is inserted into and is fitted into the female terminal 120 from the other end in the axial direction. Therefore, the rod-like body 21 has a male terminal fitting portion 21*a*, which is inserted into and is fitted into the female terminal 120, on the other end.

The male terminal 20 is disposed relative to the coupling member 30 so as to turn as the axis of the male terminal 20 is inclined. Therefore, the male terminal 20 includes a spherical turning fulcrum body 22 which is provided at one end in the axial direction and enables the male terminal 20 to turn relative to the coupling member 30 about the one end as a fulcrum (FIGS. 3, and 5 to 9). The turning fulcrum body 22 is disposed on the side of the connector extraction direction of the male terminal 20.

Figure 6:
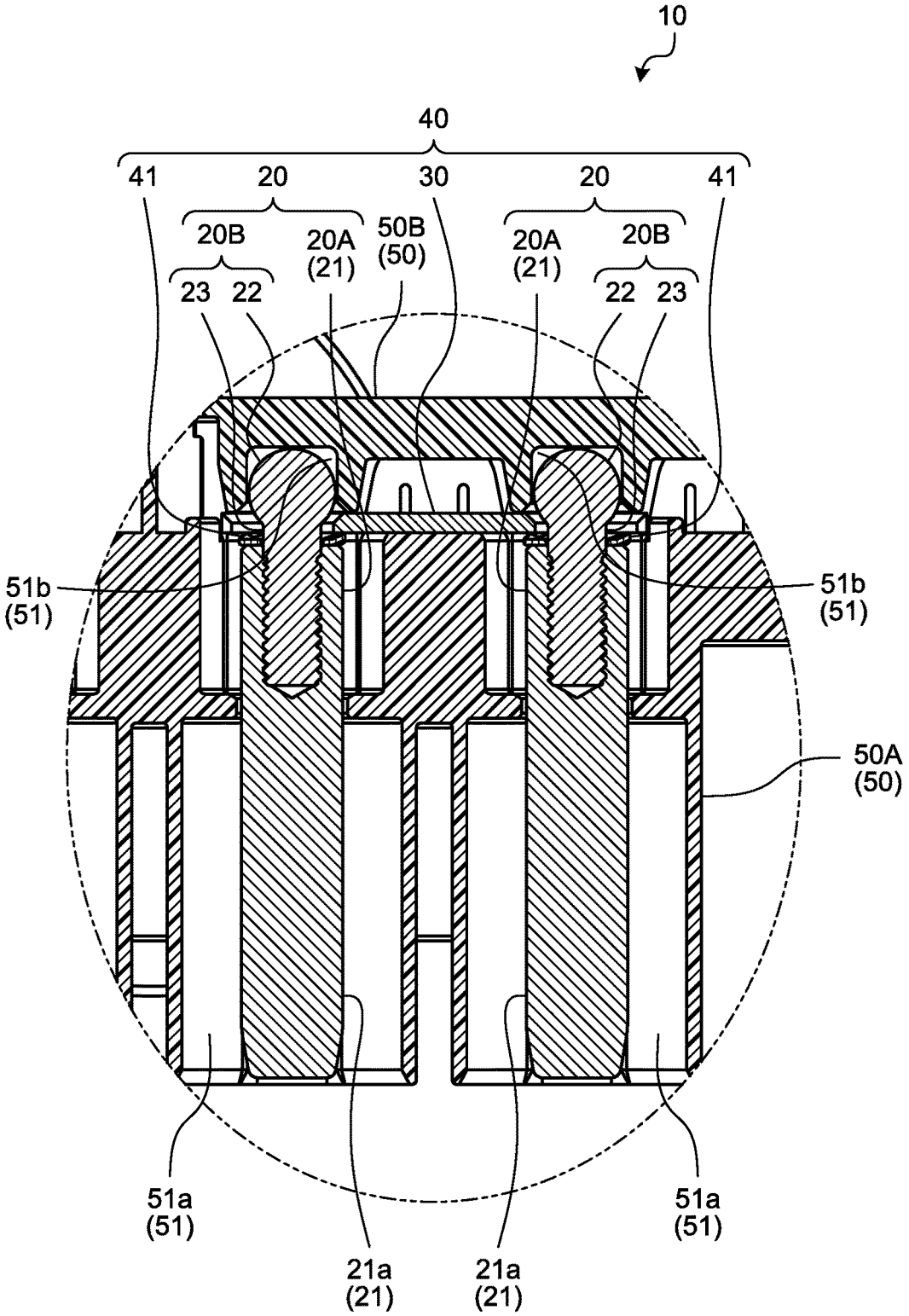
FIG. 6 is an enlarged view of a portion A in FIG. 3.
Figure 7:
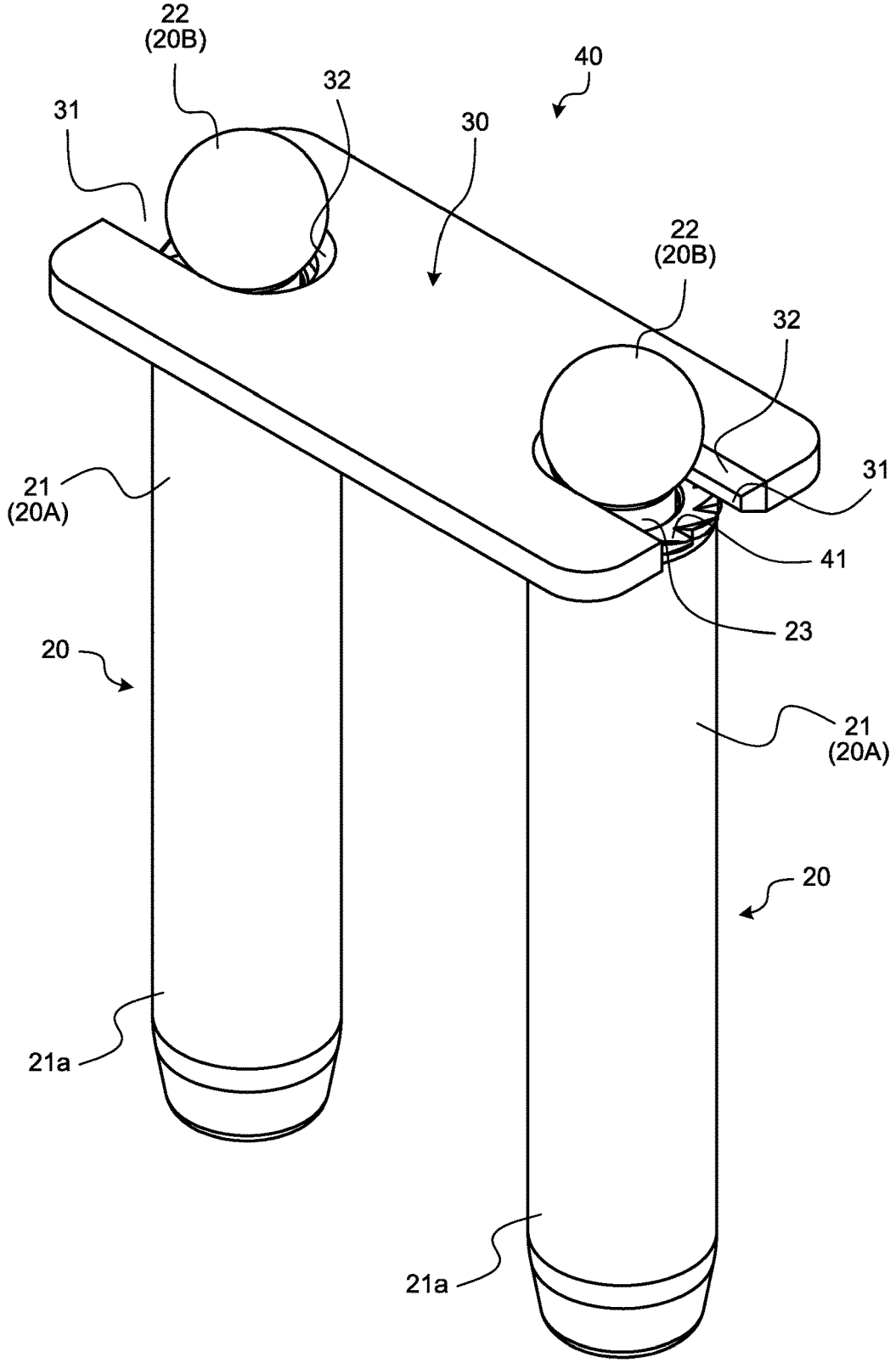
FIG. 7 is a perspective view of a male terminal assembly.
Figure 8:
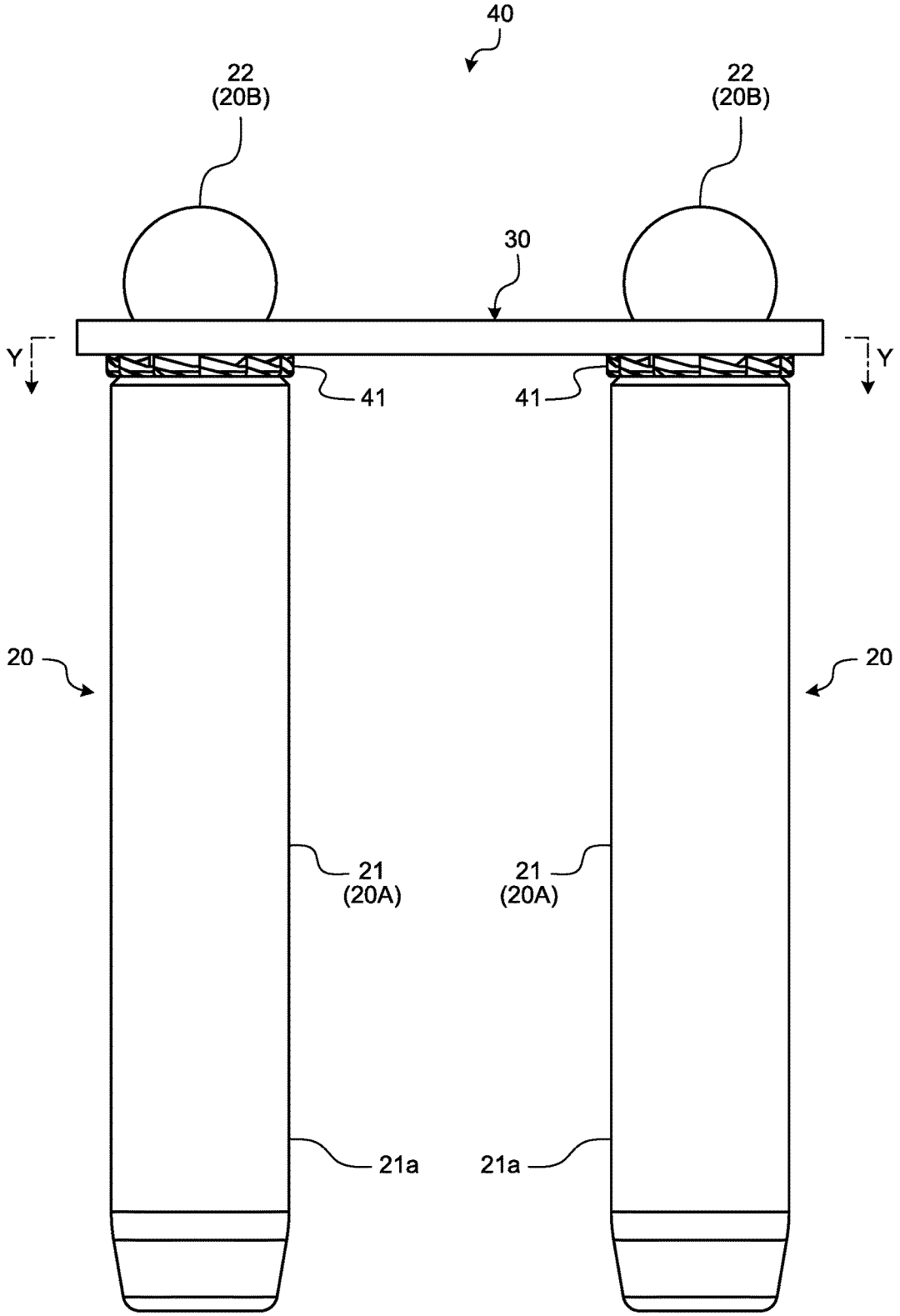
FIG. 8 is a plan view of the male terminal assembly.
Figure 9:
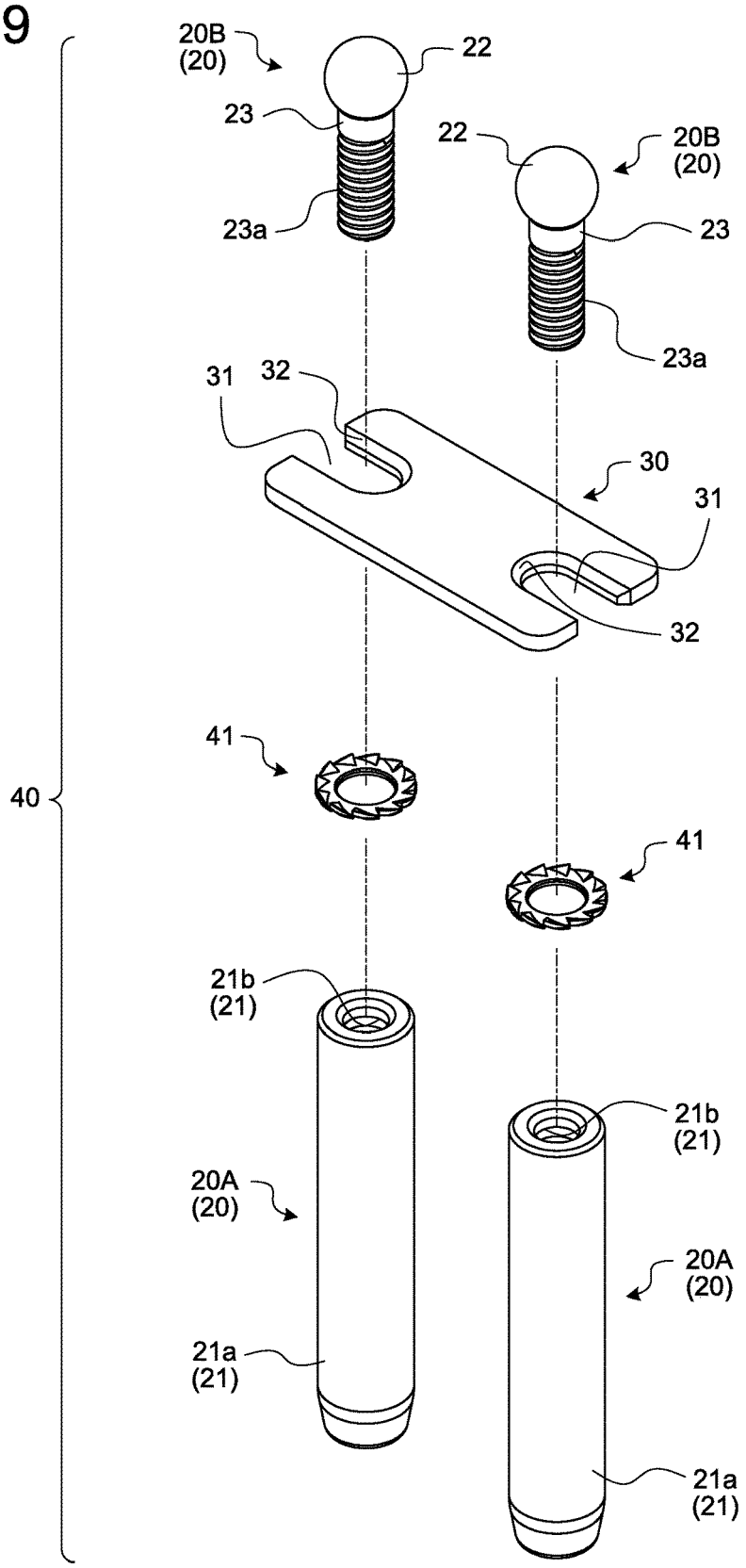
FIG. 9 is an exploded perspective view of the male terminal assembly.

In addition, the male terminal 20 has a coupling body 23 which couples the rod-like body 21 with the turning fulcrum body 22 (FIGS. 6, 7, and 9). In the male terminal assembly 40, by interposing the coupling member 30 between the rod-like body 21 and the turning fulcrum body 22, the rod-like body 21 can turn relative to the coupling member 30 about the turning fulcrum body 22 as a fulcrum. Therefore, the male terminal 20 is disposed in a state where the coupling body 23 is inserted into the coupling member 30. The coupling body 23 is a rod-like member which couples the rod-like body 21 with the turning fulcrum body 22 coaxially to the rod-like body 21, and is formed in a cylindrical shape or a columnar shape.

The male terminal 20 may be formed by integrally forming the rod-like body 21, the turning fulcrum body 22, and the coupling body 23, and may be a terminal in which at least one of the rod-like body 21, the turning fulcrum body 22, and the coupling body 23 is separately formed from the remainder. The exemplary male terminal 20 includes a male terminal fitting 20A as the rod-like body 21 and a turning fulcrum member 20B as the turning fulcrum body 22 which is fixed to the male terminal fitting 20A (FIGS. 5 to 9). In the exemplary male terminal 20, the coupling body 23 is integrally formed with the turning fulcrum member 20B. In the exemplary male terminal 20, the coupling body 23 is extended along the axial direction, and the extended portion is inserted into the male terminal fitting 20A. In the male terminal fitting 20A, a coaxial female screw portion 21*b* is formed (FIG. 9). In the turning fulcrum member 20B, a male screw portion 23*a* is formed at the extended portion of the coupling body 23 (FIG. 9). In this example, the male terminal 20 is formed by screwing the male screw portion 23*a* of the turning fulcrum member 20B with the female screw portion 21*b* of the male terminal fitting 20A.

The coupling member 30 is formed of a conductive material such as metal. The coupling member 30 electrically connects the pair of male terminals 20 in the male terminal assembly 40. The exemplary coupling member 30 is formed in a rectangular plate-like shape, and two male terminal inserting portions 31 are formed in the coupling member 30. The coupling body 23 of the male terminal 20 passes through the male terminal inserting portion 31 (FIGS. 7 and 9). The male terminal inserting portion 31 may be a through-hole or a notch. In this example, a notch-like male terminal inserting portion 31 is formed.

The coupling member 30 includes a turning support portion 32 which supports the turning fulcrum body 22 by placing the spherical surface of the turning fulcrum body 22 on the plane of the coupling member 30 on the side of the turning fulcrum body 22 (FIGS. 7 and 9). The turning support portion 32 supports the turning fulcrum body 22 while enabling the turning movement of the turning fulcrum body 22 along the spherical surface. For example, the turning support portion 32 is formed as a cone-shaped counterbore.

Figure 10:
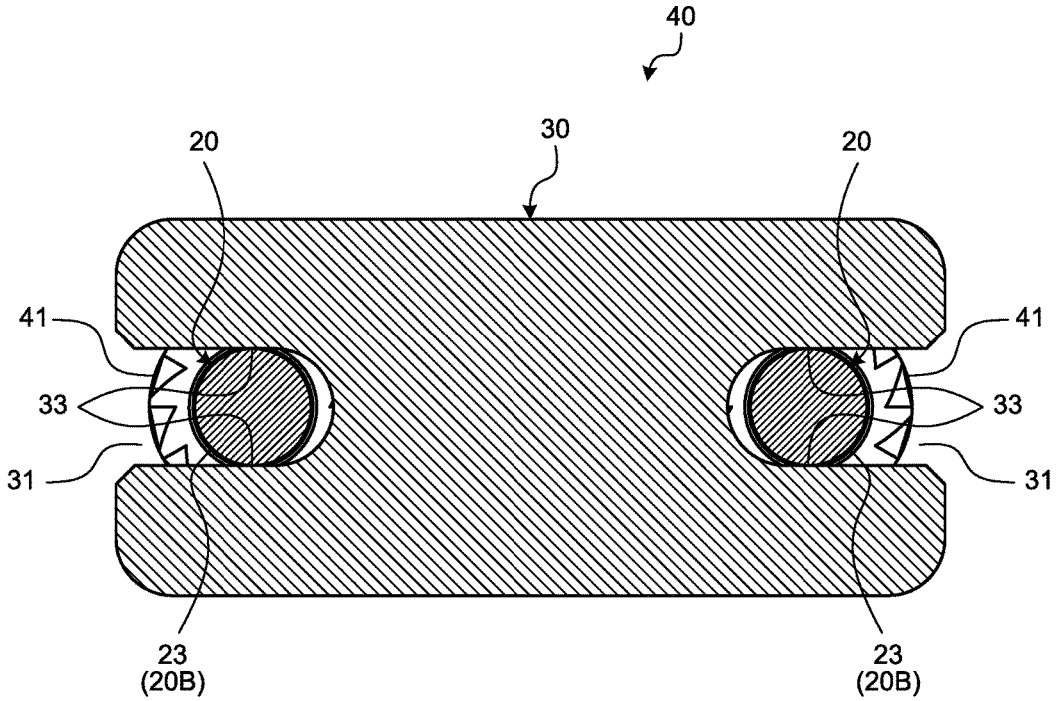
FIG. 10 is a cross-sectional view taken along lines Y-Y in FIG. 8.
Figure 11:
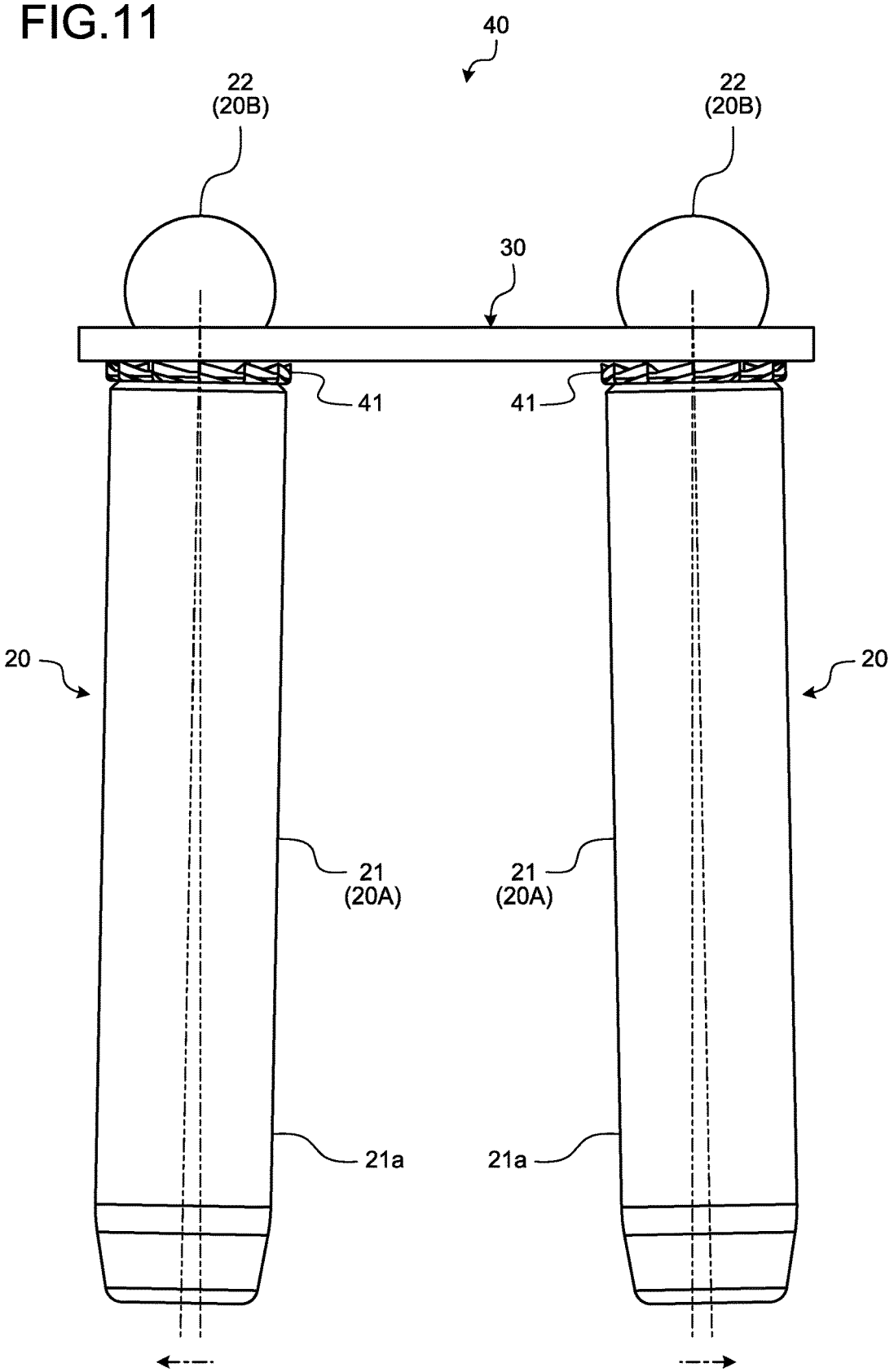
FIG. 11 is a view to describe an exemplary turning direction of a male terminal.

In addition, the turning direction of the male terminal 20 around the turning fulcrum body 22 may be regulated by locking the coupling body 23 to the coupling member 30. For example, the exemplary coupling member 30 includes a turning direction regulating portion 33 to regulate the turning direction of the male terminal 20 (FIG. 10). As the turning direction regulating portion 33, a wall surface of the male terminal inserting portion 31 is used. In this example, the turn of the pair of male terminals 20 in an alignment direction is permitted (FIG. 11). Whereas, the turn in a direction perpendicular to the alignment direction is regulated. Therefore, in the male terminal inserting portion 31, a gap between the wall surface and the coupling body 23 in the alignment direction is set according to a target turning amount, and a gap between the wall surface (turning direction regulating portion 33) and the coupling body 23 in the direction perpendicular to the alignment direction is reduced within a range not to cause a frictional resistance at the time of the turn. In FIG. 11, for convenience of description, one of the male terminals 20 is turned in a direction reverse to that of the other male terminal 20. Furthermore, the turning direction regulating portion may be provided in the first housing 50.

Regarding the male terminal 20, in a state where the coupling body 23 is inserted through the male terminal inserting portion 31, the male screw portion of the turning fulcrum member 20B is screwed into the female screw portion of the male terminal fitting 20A. The male terminal assembly 40 includes a washer 41 which is interposed between the male terminal fitting 20A and the coupling member 30 (FIGS. 6 to 11). The washer 41 holds the male terminal 20 in which the male terminal fitting 20A and the turning fulcrum member 20B are screwed with each other in the coupling member 30, and enables the male terminal 20 to turn relative to the coupling member 30 about the turning fulcrum body 22 as a fulcrum. Therefore, when the male terminal fitting 20A and the turning fulcrum member 20B have been screwed with each other, the washer 41 is attached, for example, to be bent by an external force along the axial direction. For example, in the male terminal assembly 40, in accordance with the maximum bent amount of the washer 41 along the axial direction, a turning amount of the male terminal 20 relative to the coupling member 30 can be adjusted.

Figure 5:
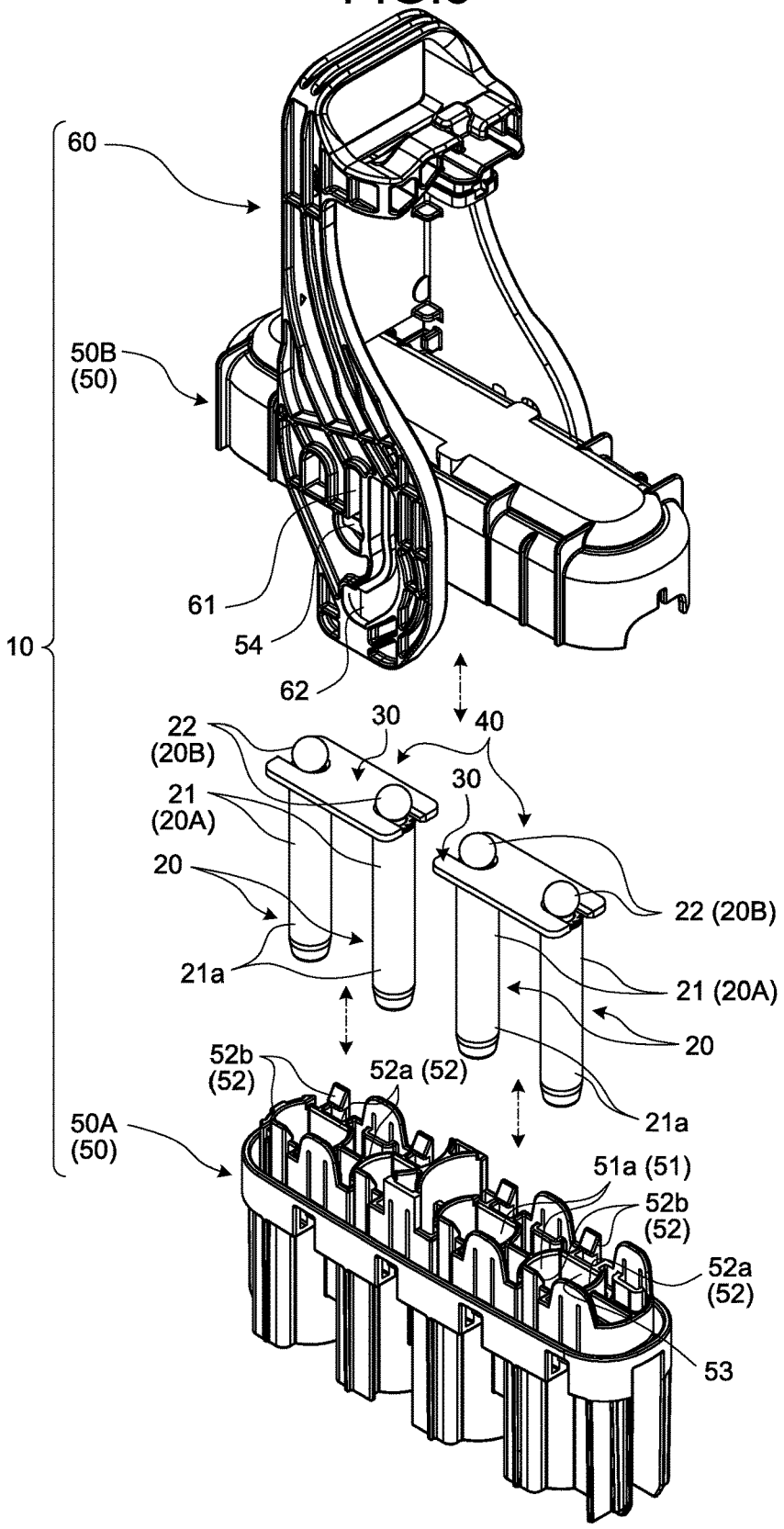
FIG. 5 is an exploded perspective view of a first connector.

The first housing 50 is formed of an insulating material such as a synthetic resin. The first housing 50 includes a male terminal housing chamber 51 which houses the male terminal 20 (FIGS. 3, 5, and 6) and a holding mechanism 52 which holds the coupling member 30 (FIG. 5).

Figure 3:
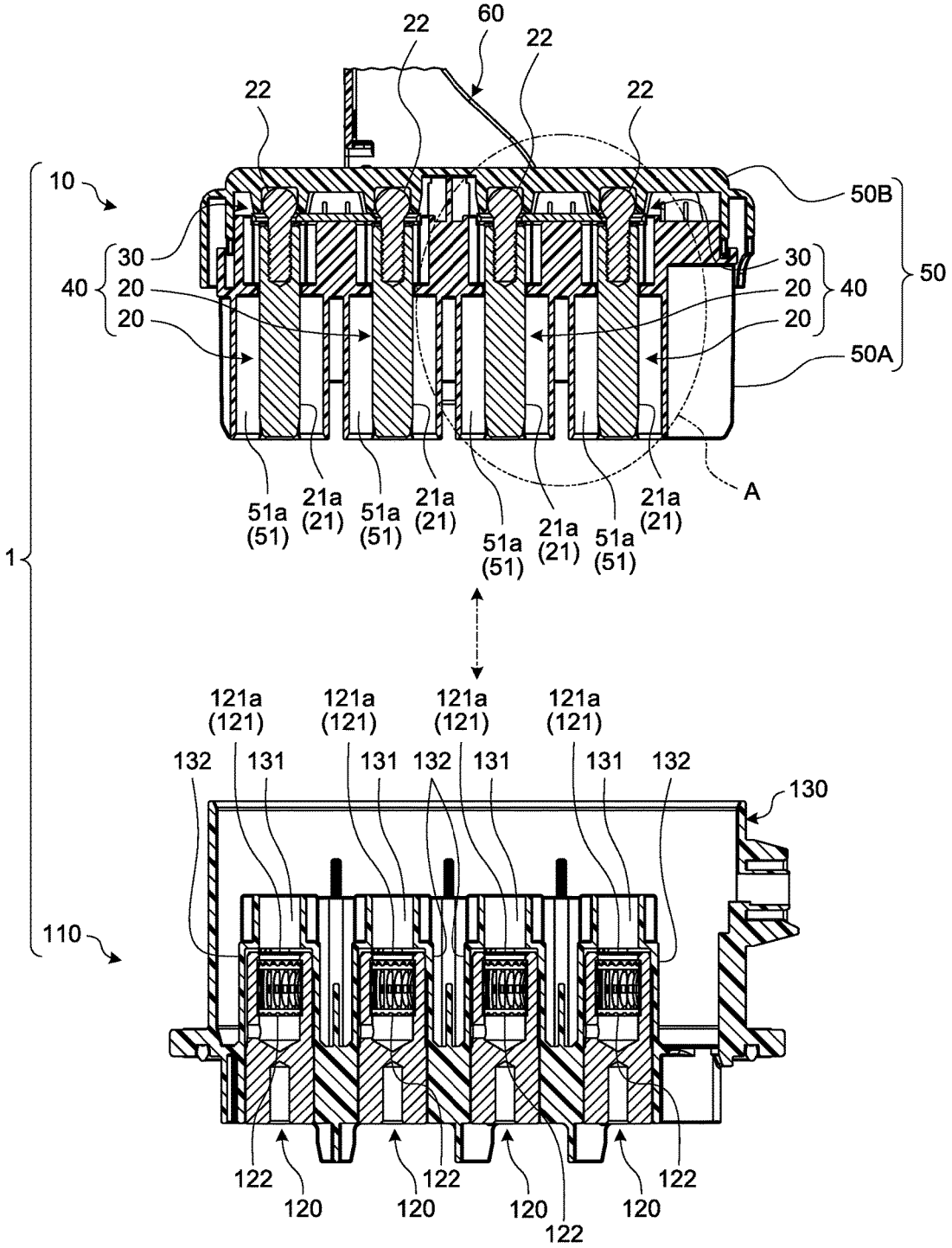
FIG. 3 is a cross-sectional view taken along lines X1-X1 in FIG. 1.

The male terminal housing chamber 51 is formed for each male terminal 20. The male terminal housing chamber 51 has a columnar space 51*a*, and the male terminal fitting 20A (rod-like body 21) is coaxially disposed in the space 51*a* (FIGS. 3, 5, and 6). The male terminal housing chamber 51 is formed so that an annular gap is provided between the inner peripheral surface of the male terminal housing chamber 51 and the male terminal fitting 20A (rod-like body 21). A fitting portion 132 of a second housing 130 of the second connector 110 to be described later is inserted into the annular gap.

The male terminal housing chamber 51 includes a turning support portion 51*b* which supports the turning fulcrum body 22 while enabling the turning movement of the turning fulcrum body 22 along the spherical surface (FIG. 6). The turning support portion 51*b* has, for example, a curved surface having a curvature smaller than that of the turning fulcrum body 22. The turning fulcrum body 22 is rotatably held by the turning support portion 51*b* of the first housing 50 and the turning support portion 32 of the coupling member 30.

Here, the first housing 50 is formed by assembling a plurality of housing members with each other. The first housing 50 in this example includes a first housing member 50A and a second housing member 50B which are assembled with each other along the connector insertion/extraction direction (FIGS. 1 and 3 to 6). In the first housing 50, the first housing member 50A is disposed on the connector insertion direction side, and the second housing member 50B is disposed on the connector extraction direction side. The space 51*a* of the male terminal housing chamber 51 is formed in the first housing member 50A. The turning support portion 51*b* is formed in the second housing member 50B.

The holding mechanism 52 is provided in at least one of the first housing member 50A and the second housing member 50B. In this example, the first housing member 50A includes a first holding portion 52*a* and a second holding portion 52*b* (FIG. 5). By sandwiching the coupling member 30 by the first holding portion 52*a* and the second holding portion 52*b*, the coupling member 30 is held in the first housing 50. Here, an end of a wall body 53 forming the space 51*a* is used as the first holding portion 52*a*. Therefore, the first holding portion 52*a* is provided for each male terminal 20. The first holding portion 52*a* is brought into contact with the plane of the coupling member 30 on the side of the rod-like body 21. For example, a pressing force from the first holding portion 52*a* toward the connector extraction direction is applied against the plane of the coupling member 30. The second holding portion 52*b* is provided as a claw to be hooked to the plane of the coupling member 30 on the side of the turning fulcrum body 22. For example, a pressing force from the second holding portion 52*b* toward the connector insertion direction is applied against the plane of the coupling member 30. The plurality of second holding portions 52*b* is provided for each coupling member 30.

The male terminal assembly 40 is held by the first housing 50 via the coupling member 30 held by the holding mechanism 52. Here, the holding mechanism 52 holds the coupling member 30 in the first housing 50 so that the coupling member 30 is not relatively moved with respect to the first housing 50. The male terminal 20 can turn relative to the coupling member 30 in the male terminal housing chamber 51 about the turning fulcrum body 22 as a fulcrum, and can turn relative to the first housing 50 in the male terminal housing chamber 51 about the turning fulcrum body 22 as a fulcrum.

Figure 4:
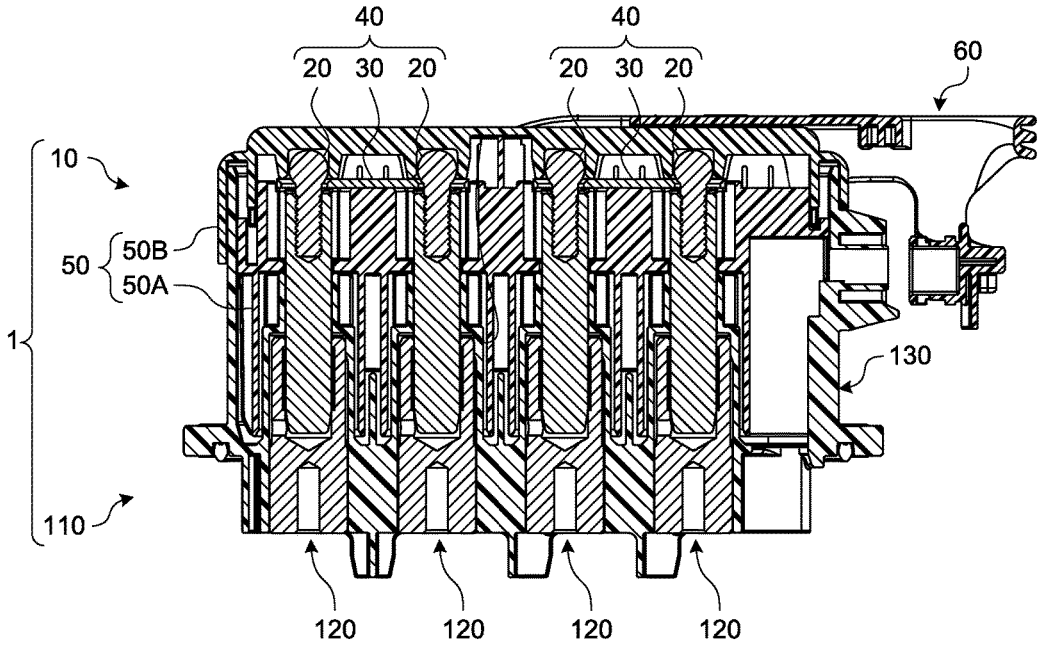
FIG. 4 is a cross-sectional view taken along lines X2-X2 in FIG. 2.
Figure 12:
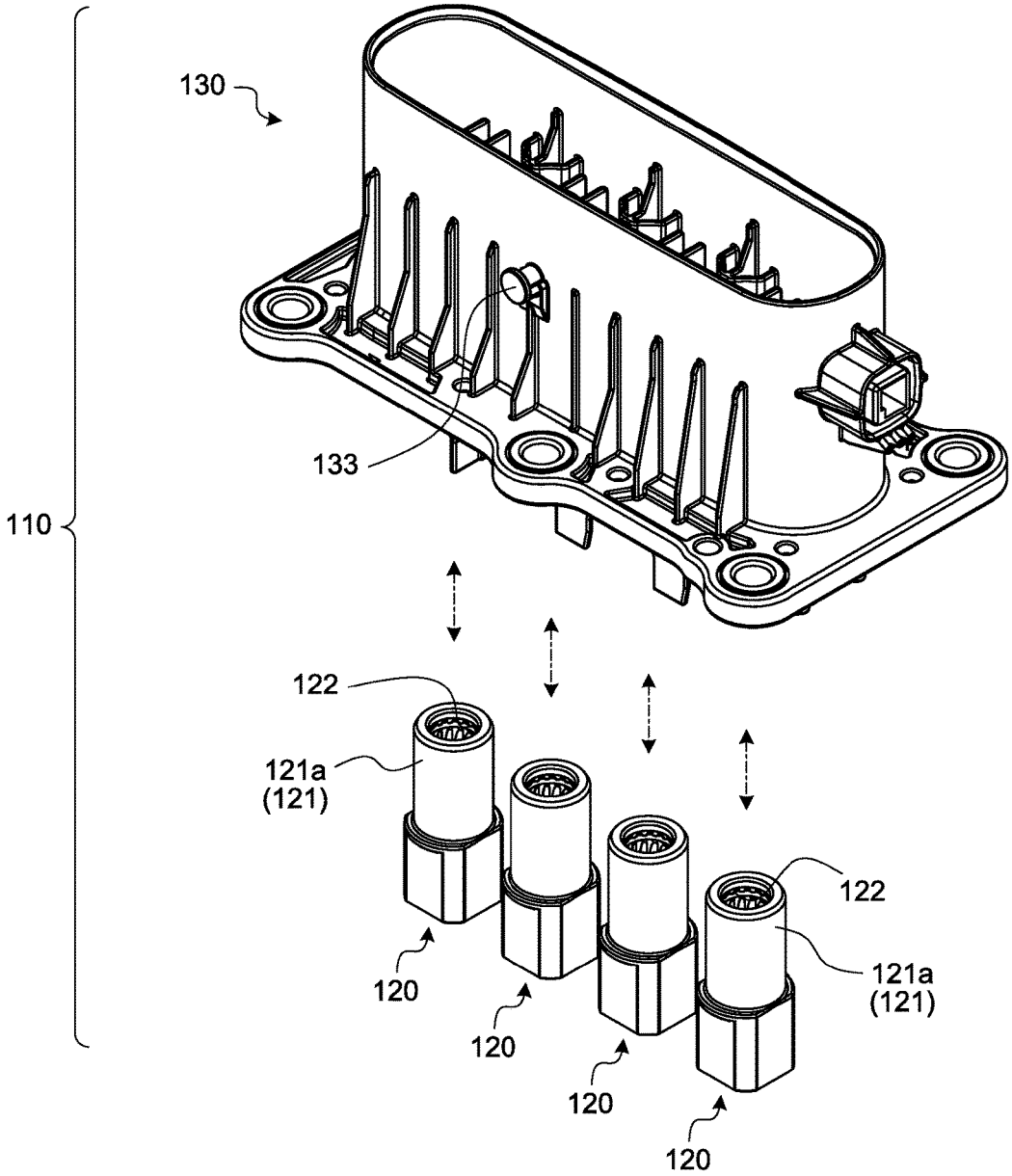
FIG. 12 is an exploded perspective view of a second connector.
Figure 13:
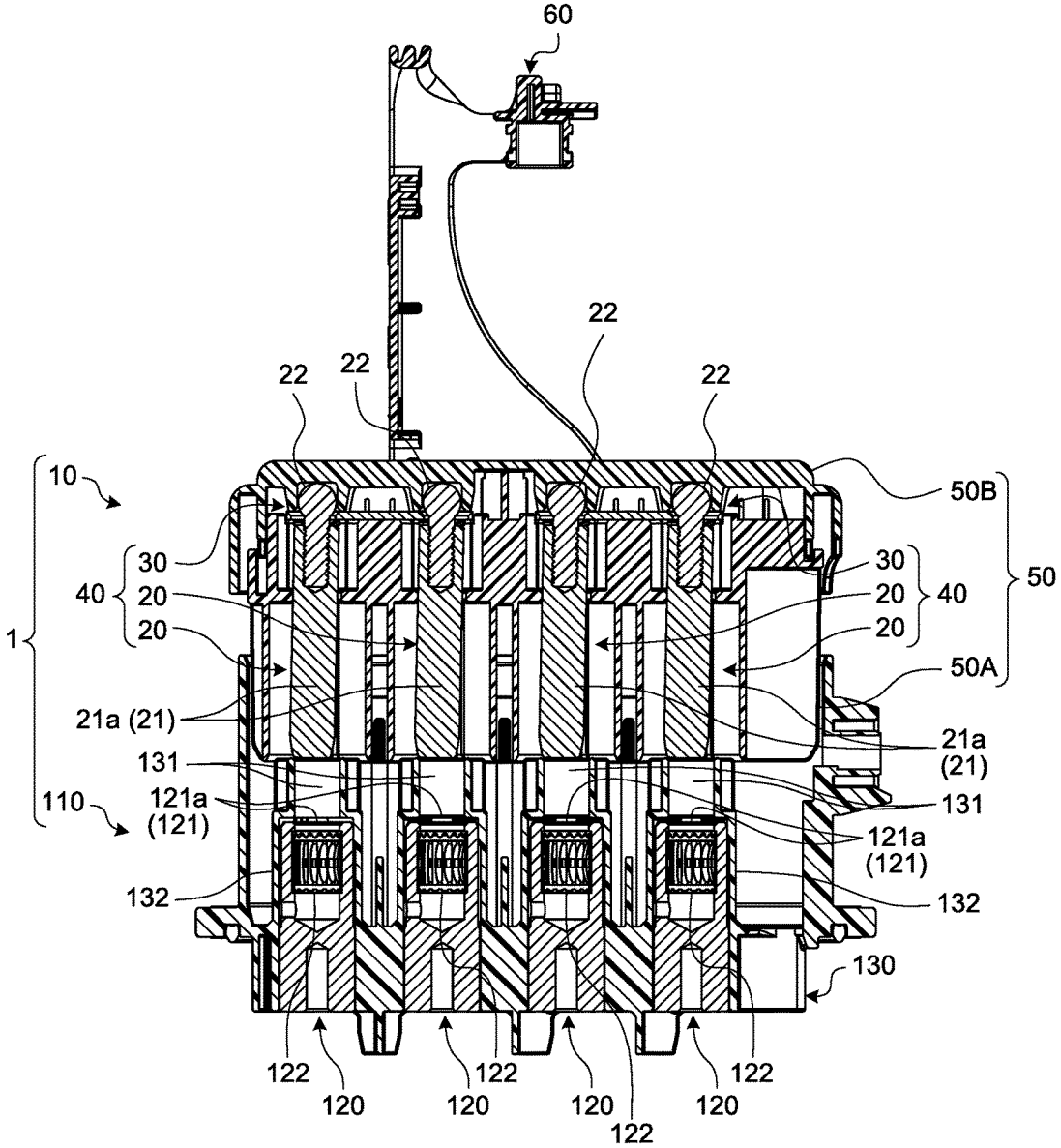
FIG. 13 is a cross-sectional view of an exemplary connector fitting process.

The second connector 110 includes the female terminal 120 and the second housing 130 which houses the female terminal 120 (FIGS. 3, 4, and 12). In the second connector 110, the female terminal 120 for each male terminal 20 of the first connector 10 is housed in the second housing 130.

The female terminal 120 is physically and electrically connected to a counterpart conductive member (male terminal 20). The female terminal 120 is physically and electrically connected to the male terminal 20 by inserting and fitting the male terminal 20 into the female terminal 120 from the other end in the axial direction along the axial direction.

The female terminal 120 includes a female terminal fitting 121 as a main body and a contact member 122 as a contact (FIGS. 3 and 12). The female terminal fitting 121 is formed of a conductive material such as metal. The female terminal fitting 121 includes a female terminal fitting portion 121*a* which is formed in a cylindrical shape to which the male terminal fitting portion 21*a* of the male terminal 20 can be coaxially inserted. The contact member 122 is formed into a cylindrical shape by using a metal plate as a base material and applying press processing such as cutting and bending to the metal plate. The contact member 122 is formed to be elastically deformed in the radial direction. The contact member 122 is coaxially disposed in the female terminal fitting portion 121*a*. By having contact with the inner peripheral surface of the female terminal fitting portion 121*a*, the contact member 122 is electrically connected to the female terminal fitting portion 121*a*. Furthermore, when the male terminal fitting portion 21*a* is fitted into the contact member 122, the contact member 122 is electrically connected to the male terminal fitting portion 21*a* by being deformed outward in the radial direction by the male terminal fitting portion 21*a*.

An electric wire which is not illustrated is electrically connected to the female terminal 120. For example, in the connector device 1, the female terminal 120 which is connected to one of the male terminals 20 of the male terminal assembly 40 is electrically connected to a power supply (which is not illustrated) via the electric wire, and the female terminal 120 which is connected to the other male terminal 20 of the male terminal assembly 40 is electrically connected to a load (which is not illustrated) via the electric wire. In this case, the connector device 1 is used to create an electrically connected state between the power supply and the load and to disconnect the electrically connected state between the power supply and the load. In the connector device 1, the first connector 10 and the second connector 110 are inserted into and connected to each other to form the energizing circuit, and the power supply is electrically connected to the load via the energizing circuit. On the other hand, in the connector device 1, the energizing circuit is disconnected by extracting and separating the first connector 10 and the second connector 110 from each other, and the electrically connected state between the power supply and the load is disconnected.

The second housing 130 is formed of an insulating material such as a synthetic resin. The second housing 130 includes a female terminal housing chamber 131 which coaxially houses and holds the female terminal 120 (FIG. 3). The female terminal housing chamber 131 is formed for each female terminal 120. The female terminal housing chamber 131 is formed as a columnar space, and the female terminal 120 is coaxially fitted in the inner peripheral surface of the female terminal housing chamber 131. The second housing 130 includes the cylindrical fitting portion 132, and a space in the fitting portion 132 is used as a part of the female terminal housing chamber 131. The fitting portion 132 is inserted into the annular gap between the inner peripheral surface of the male terminal housing chamber 51 and the male terminal fitting 20A (rod-like body 21) described above. In the connector device 1, according to the above insertion, the male terminal 20 and the female terminal 120 are electrically connected to each other.

In the connector device 1 according to the present embodiment, for example, the male terminal 20 is attached to the coupling member 30 in an inclined state, and even when the male terminal 20 is inclined relative to the connector insertion/extraction direction (FIG. 13), a fitting operation force at the time of connector fitting can be suppressed. At the time of the connector fitting, for example, when the male terminal 20 has contact with the female terminal housing chamber 131 and the female terminal 120, the male terminal 20 turns about the turning fulcrum body 22 as a fulcrum by receiving the force from the female terminal housing chamber 131 and the female terminal 120, the inclination of the male terminal 20 with respect to the connector insertion/extraction direction is reduced. Therefore, in the connector device 1, even if the male terminal 20 is inclined with respect to the connector insertion/extraction direction, the first connector 10 and the second connector 110 can be fitted to each other with a low fitting operation force.

For the similar reason, in the connector device 1, even when the first connector 10 starts to be fitted into the second connector 110 in an inclined state, the fitting operation force at the time of the connector fitting can be reduced to be low. That is, at the time of the connector fitting, in the connector device 1, for example, when the male terminal 20 has contact with the female terminal housing chamber 131 and the female terminal 120, the male terminal 20 turns about the turning fulcrum body 22 as a fulcrum by receiving the force from the female terminal housing chamber 131 and the female terminal 120, and the inclination of the male terminal 20 relative to the connector insertion/extraction direction is reduced. Therefore, in the connector device 1, even if the first connector 10 starts to be fitted into the second connector 110 in an inclined state, the first connector 10 can be fitted into the second connector 110 with a low fitting operation force.

Furthermore, in the connector device 1, since the male terminal 20 can turn about the turning fulcrum body 22 as a fulcrum, a force larger than a necessary force for electrical connection is not applied between the male terminal 20 and the female terminal 120 of which the connectors have been fitted to each other. Therefore, in the connector device 1, when the first connector 10 is separated from the second connector 110, the first connector 10 can be extracted from the second connector 110 with a low extracting operation force.

As described above, in the connector device 1 according to the present embodiment, since the first connector 10 can be inserted into and extracted from the second connector 110 with a low operation force, workability at the time of inserting and extracting the connector can be improved.

In the exemplary connector device 1, a lever 60 which assists the operation force used for connector insertion and extraction is provided (FIGS. 1 to 5 and 13).

The lever 60 is rotatably attached to the first housing 50. In this example, the lever 60 can be turned with respect to the first housing 50 (that is, lever operation) by turning shaft portions 54 of the second housing member 50B and first guides 61 of the lever 60. In the second housing member 50B, two turning shaft portions 54 are provided as coaxial projections at an interval. The first guide 61 is a through-hole or a groove to which the turning shaft portion 54 is inserted, and is provided for each turning shaft portion 54 in the lever 60. The first guide 61 includes a bearing which supports the turn with respect to the turning shaft portion 54. The exemplified lever 60 can be freely turned within a range of about 90 degrees with respect to the first housing 50.

The lever 60 relatively moves the first housing 50 to the second housing 130 along the connector insertion/extraction direction in conjunction with the turning movement with respect to the first housing 50. When the lever 60 is turned in one direction, the first housing 50 is relatively moved with respect to the second housing 130 along the connector insertion direction. When the lever 60 is turned in the other direction, the first housing 50 is relatively moved with respect to the second housing 130 along the connector extraction direction. In this example, a guided portion 133 of the second housing 130 and a second guide 62 of the lever 60 realize the relative movements described above. In the second housing 130, two guided portions 133 are provided as coaxial projections at an interval. The guided portion 133 projects in the same direction as the turning shaft portion 54. The second guide 62 is an arc-shaped through-hole or groove in which the guided portion 133 is inserted, and provided for each guided portion 133 in the lever 60.

In the connector device 1, since the lever operation assists the fitting operation force to fit the first connector 10 and the second connector 110 to each other, together with the turning movement of the male terminal 20 about the turning fulcrum body 22 as a fulcrum described above, the connectors can be fitted to each other with a lower fitting operation force. In addition, in the connector device 1, since the lever operation assists the extracting operation force to extract the first connector 10 from the second connector 110, together with the turning movement of the male terminal 20 about the turning fulcrum body 22 as a fulcrum, the first connector 10 can be extracted from the second connector 110 with a lower extracting operation force. In this way, in the connector device 1, since the first connector 10 and the second connector 110 can be inserted into and extracted from each other with a lower operating force, the workability at the time of inserting and extracting the connector can be further improved.

In the connector device according to the embodiment, at the time of the connector fitting, for example, when the male terminal has contact with the female terminal housing chamber and the female terminal, the male terminal turns about the turning fulcrum body as a fulcrum by receiving a force from the female terminal housing chamber and the female terminal, the inclination of the male terminal with respect to a connector insertion/extraction direction is reduced. Therefore, in the connector device, even if the male terminal is inclined with respect to the connector insertion/extraction direction, the first connector and the second connector can be fitted to each other with a low fitting operation force. Furthermore, in the connector device, since the male terminal can turn about the turning fulcrum body as a fulcrum, a force which is not larger than a necessary force for electrical connection is acted between the male terminal and the female terminal of which the connectors have been fitted to each other. Therefore, in the connector device, when the first connector is separated from the second connector, the first connector can be extracted from the second connector with a low extracting operation force. In this way, in the connector device according to the present invention, since the first connector and the second connector can be inserted into and extracted from each other with a lower operating force, the workability at the time of inserting and extracting the connector can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector device comprising:

a first connector that includes a pair of male terminals of which axial directions of rod-like bodies having a circumferential surface are arranged in the same direction and which is aligned at an interval, a conductive coupling member which couples one ends of the respective male terminals in the axial direction to each other, and a first housing which includes a male terminal housing chamber housing each the male terminal and a holding mechanism which holds the coupling member; and a second connector that includes a cylindrical female terminal, into which each the male terminal is inserted and fitted from the other end in the axial direction along the axial direction, for each male terminal and a second housing which includes a columnar female terminal housing chamber which coaxially houses and holds the female terminal for each female terminal, wherein the male terminal includes the rod-like body having a male terminal fitting portion which is inserted into and fitted with the female terminal on a side of the other end, and a spherical turning fulcrum body which is provided at the one end and enables the male terminal to turn relative to the coupling member in the male terminal housing chamber about the one end as a fulcrum, and in an assembly of the pair of male terminals and the coupling member, the coupling member is interposed between the rod-like body and the turning fulcrum body.

2. The connector device according to claim 1, wherein the male terminal housing chamber includes a turning support portion which enables a turning movement of the turning fulcrum body along a spherical surface and supports the turning fulcrum body.

3. The connector device according to claim 2, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

4. The connector device according to claim 2, wherein the assembly includes a washer which is interposed between the male terminal fitting and the coupling member.

5. The connector device according to claim 4, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

6. The connector device according to claim 2, wherein the male terminal includes a male terminal fitting as the rod-like body and a turning fulcrum member as the turning fulcrum body to be fixed to the male terminal fitting.

7. The connector device according to claim 6, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

8. The connector device according to claim 6, wherein the assembly includes a washer which is interposed between the male terminal fitting and the coupling member.

9. The connector device according to claim 8, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

10. The connector device according to claim 1, wherein the assembly includes a washer which is interposed between the male terminal fitting and the coupling member.

11. The connector device according to claim 10, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

12. The connector device according to claim 1, wherein the male terminal includes a male terminal fitting as the rod-like body and a turning fulcrum member as the turning fulcrum body to be fixed to the male terminal fitting.

13. The connector device according to claim 12, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

14. The connector device according to claim 12, wherein the assembly includes a washer which is interposed between the male terminal fitting and the coupling member.

15. The connector device according to claim 14, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

16. The connector device according to claim 1, wherein the male terminal includes a coupling body which couples the rod-like body with the turning fulcrum body, and the coupling member includes a male terminal inserting portion through which the coupling body is inserted and passes and a turning direction regulating portion which regulates a turning direction of the male terminal about the turning fulcrum body as a fulcrum by locking the coupling body.

* * * * *